US011365519B2

(12) United States Patent
Maxwell

(10) Patent No.: US 11,365,519 B2
(45) **Date of Patent: *Jun. 21, 2022**

(54) SMOOTHING APPARATUS FOR SMOOTHING PAVEMENT SURFACES

(71) Applicant: Garlon J. Maxwell, Eagle Mountain, UT (US)

(72) Inventor: Garlon J. Maxwell, Eagle Mountain, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/895,382

(22) Filed: Jun. 8, 2020

(65) Prior Publication Data

US 2021/0010212 A1 Jan. 14, 2021

Related U.S. Application Data

(63) Continuation of application No. 15/821,738, filed on Nov. 22, 2017, now Pat. No. 10,676,880.

(60) Provisional application No. 62/426,225, filed on Nov. 23, 2016.

(51) Int. Cl.

| | |
|---|---|
| ***E01C 23/06*** | (2006.01) |
| ***E01C 23/01*** | (2006.01) |
| ***E01C 23/08*** | (2006.01) |
| ***E01C 23/088*** | (2006.01) |
| ***E01C 23/082*** | (2006.01) |

(52) U.S. Cl.

CPC ..... *E01C 23/065* (2013.01); *E01C 23/01* (2013.01); *E01C 23/088* (2013.01); *E01C 23/0825* (2013.01)

(58) Field of Classification Search

CPC .... E01C 23/065; E01C 23/01; E01C 23/0825; E01C 23/088

See application file for complete search history.

(56) References Cited

U.S. PATENT DOCUMENTS

| | | | | | |
|---|---|---|---|---|---|
| 4,172,679 | A * | 10/1979 | Wirtgen | E01C 7/187 | 37/223 |
| 4,195,946 | A * | 4/1980 | Swisher, Jr. | E01C 11/005 | 404/75 |
| 4,473,320 | A * | 9/1984 | Register | E01C 23/065 | 404/101 |
| 5,388,893 | A * | 2/1995 | Maxwell | E01C 23/088 | 299/39.6 |
| 6,682,261 | B1 * | 1/2004 | Karamihas | E01C 23/07 | 299/1.5 |
| 8,573,885 | B2 * | 11/2013 | Latham | E01C 23/088 | 404/94 |
| 2008/0035386 | A1 * | 2/2008 | Hall | E21C 35/19 | 175/425 |
| 2011/0020063 | A1 * | 1/2011 | Abresch | E01C 23/0993 | 404/17 |
| 2012/0128419 | A1 * | 5/2012 | Menzenbach | E01C 21/00 | 404/76 |
| 2012/0243939 | A1 * | 9/2012 | Oxford | E01C 23/088 | 404/90 |

(Continued)

*Primary Examiner* — Abigail A Risic
(74) *Attorney, Agent, or Firm* — James Sonntag

(57) ABSTRACT

An apparatus for smoothing pavement surfaces includes a wheeled frame and a smoothing drum where the smoothing drum is rotatable on a spinning axis mounted on the wheeled frame generally parallel to a pavement surface to be smoothed, and at a non-perpendicular angle to to the direction of travel of the smoothing device.

9 Claims, 12 Drawing Sheets

(56) References Cited

U.S. PATENT DOCUMENTS

| | | | | |
|---|---|---|---|---|
| 2013/0038114 | A1* | 2/2013 | Hausladen | E21C 47/00 299/39.4 |
| 2014/0147207 | A1* | 5/2014 | Parsons, Jr. | E01C 23/088 404/91 |
| 2014/0265525 | A1* | 9/2014 | Schafer | E01C 23/088 299/39.1 |
| 2017/0022674 | A1* | 1/2017 | Stark | E01C 23/0946 |
| 2019/0085515 | A1* | 3/2019 | Cochran | E02F 3/20 |

* cited by examiner

SMOOTHING APPARATUS FOR SMOOTHING PAVEMENT SURFACES

BACKGROUND

As roads deteriorate they may become disturbed and uneven. Settling of pavement and settling of layers underneath the pavement are examples of deterioration phenomena that cause roadway surfaces to become uneven. Potholes, thermal cracks, and alligator cracking may also cause significant roadway bumps and dips. Such deterioration may damage vehicle shocks, tires, and springs when driven upon. Smoother roads may reduce vehicle damage and accidents while affording drivers a safer and more comfortable roadway experience.

Damaged pavement can be repaired and even partially replaced. However, such do not always restore a pavement surface to the smoothness to that of the new originally installed pavement. To restore smoothness, irregularities have been reduced by using machinery that grinds the surface of the payment smoother, particularly on high-speed highways. The intent is to restore rideability by removing surface irregularities caused during construction or through water penetrating the asphalt pavement or water penetrating open cracks.

Uneven pavement surfaces can be smoothed by grinding. This can be relatively inexpensive when compared to other maintenance options. Notwithstanding, road grinding for road smoothing has been used in only a limited variety of applications. This is in part due to the fact that the grinding requirements vary. Not all pavements require the same amount of road grinding. Some roads vary significantly in altitude over short distances while other roads vary little in altitude over long distances. Some pavements are relatively smooth, while other pavements are comparatively uneven. Further, paved surfaces often have irregularities and bumps from a number of causes that can cause discomfort for riders and problems for vehicles driving over them. Some pavements may be rough in only certain localized regions, while other pavements may have roughness over their full surface.

Pavement smoothness is a factor relating to both safety and comfort. Smoothing a pavement surface is not reducing the surface to a flat horizontal surface. Rather it involves removing irregularities in the pavement profile while following the primary profile of the pavement.

One factor in defining smoothness is roughness. Roughness relates to large irregularities and is a general description of the forces imparted to a vehicle that cause sudden movements of the vehicle and deflection of the suspension. Another factor in pavement smoothness involves the surface texture of the pavement surface. While roughness primarily involves vehicle suspension deflection and dynamic tire loads, the surface texture is involved more with the interaction between the road surface and the tire footprint. Surface texture relates to generally periodic irregularities that have wavelengths shorter than those of roughness, between about 50 mm and 0.5 mm. Surface texture is partly a desired property and partly an undesired property. Short texture waves, about 5 mm, act as acoustical pores and reduce tire/road noise. On the other hand, long wave texture irregularities increase noise. Texture can provide wet road friction, especially at high speeds, but excessive texture increases rolling resistance and thus fuel consumption. The goal in smoothing is to provide an optimum surface texture. Texture on the surface of about 0.1 to 0.25 mm from peak to valley is desired for tire traction and for removal of air trapped under passing tires.

Various grinding machines have been used for various surface grinding applications. These essentially fall into two types, (1) rotomills and (2) diamond grinders. Rotomills generally comprise a drum rotating on an axis parallel to the pavement surface that is carried on wheels over the surface in a direction transverse to the rotating axis. Teeth with hardened tips are spaced on the drum to provide a cutting action as the drum rotates. Rotomills are primarily designed for rapidly removing large quantities of pavement. Attempts have been made to modify rotomills to provide some surface smoothing. However, to change a machine originally developed for grinding be removing large amounts to a machine for the precision removal of a thin amount material with the purpose not to remove the material but to leave a smooth pavement surface, has not been fully successful. This is the case even for so called micro grinders. Because of several limitations, rotomills have not been able to accurately perform road smoothing of less than about ¼ inch (6 mm). This is apparent when driving over a surface ground by a rotomill. It is not smooth to the driver or the vehicle.

One of the reasons rotomills are generally not suitable for grinding is that the base of the wheels supporting the drum (usually based upon standard wheeled truck highway transport systems) is too narrow. Rotomill cutting drums wide enough to smooth an entire travel lane are commonly wider than the wheel base. Accordingly, any difference in wheel height is amplified at the ends by the overhang, causing the cutting drum to be raised a little more on one side than another, which is unacceptable for precise road grinding tolerances.

In many smoothing machines there is some kind of leveling system so that the cutting height of the drum doesn't respond to every irregularity in the pavement. This can be, for example, a system that adjusts the height of the drum based upon vertical movement of a wheel traveling ahead of a drum. The leveling systems in rotomills commonly do not have a long wheel base from front to back necessary for this accurate road grinding. The too-short wheel base makes the height of the cutting wheel too reactive to short-term variations creating at best a wavy ground surface.

Leveling systems can also include automatic controls comprising sensors and hydraulic systems that can adjust cutting drum height. Another reason that rotomills are inaccurate for road grinding is because the automatic controls used in rotomills are inadequate to compensate to small changes in pavement height, particularly in the range within about ⅛ inch (3 mm). This inadequacy is caused by the automatic control's inability to hold the cutting drum steady. Although, automatic controls react to changes in the pavement surface and readjust cutting height accordingly, they also respond other extraneous movements, such as small movements in the wheeled trucks, cylinders, etc. The automatic controls interpret these small movements as road irregularities. Compensation to these ghost irregularities can result in a surface that is less smooth than the original. In addition compensation by the automatic controls can increase these extraneous movements, resulting in an increasing bouncing feed-back loop. When the rotomill is stationary, this bounce results in more cutting, leaving a scallop or divot. For, example, in just ten seconds while the grinder is stationary to replace a full dump truck, this can bounce the road grinding machine enough to leave a small divot in the pavement.

In addition, most rotomill automatic controls have an ability to be set in increments of 1/10 inch (or 2/20 inches (2 mm or 1 mm)). If, for example, a ⅛ inch (3 mm) cut is desired, the automatic controls only give one setting which may be too small or too great for the situation. In conclusion, use of automatic controls is not sufficiently accurate for highly accurate road grinding.

Another problem with rotomills is their sheer size and complexity. The precision required for smoothing leaves little room for operator error. Operators typically have training and experience in grinding and removal where for example, in milling 100 to 300 tons per hour cutting several inches deep. On the other hand, operators have limited training in removing material for smoothing, for example, 0.1 ton per hour cutting 0.05 inches deep. But, even with a trained operator the complexity of the machine and the highly variable pavement conditions make it difficult to reproducibly operate a machine at the same grinding height over time and from one job to the next. This makes conventional road grinding rotomills inaccurate for smoothing and bump removal. Basically, the concept of providing precise reproducible results is only theoretical under ideal conditions, and cannot be achieved in real world conditions.

Another problem derives from the carbide teeth commonly used on rotomills, which may wear down and create uneven patterns. In addition, tooth height is variable because, teeth used on rotomill grinding drums exhibit radial variation when installed and slippage during used of as much as' inch (3 mm). Since many bumps in smoothing are cut only 1/20 inch (1 mm) and the average cuts are often 1/10 inch (2 mm), this radial variation is not acceptable for precision grinding.

Another drawback that makes rotomills inaccurate is the size of the tooth spacing. Tooth spacing on standard rotomills, even so called micro mills, is too wide to create a surface texture necessary for reducing tire noise. Larger teeth and wider spacing between the teeth may decrease precision compared to diamond grinding. The result of the spacing and variability of tooth height is a grinding drum that is variable over its surface, making it impossible to achieve precise and reproducible results. Consequently, rotomills tend to produce a rough and noisy riding surface.

Forward speeds of rotomills are not finely tuned at extremely slow speeds. Rotomills are designed for relatively fast working speeds of 40-150 feet per minute. Much slower speeds are required to provide the texture needed to leave the milled surface open to traffic. Because of this, rotomilled surfaces are almost always covered with new pavement within a few weeks.

Basically, rotomills are best used for removing large amounts of material and are used for demolition, mining, excavation, removing pavement, and the like. Their suitability for accurately and suitably smoothing pavement has not been demonstrated.

During a cutting operation, properties of a rotomill cutting drum relating to cutting vary significantly. In addition, the cutting properties from job to job vary and are not reproducible. Such variance of cutting in rotomills acceptable where there is gross removing of material and any smoothing is limited to mitigation of large irregularities. However, this variance is unacceptable for precision smoothing.

Diamond Grinders

Diamond grinders can grind bumps accurately, and can restore a pavement smoothness to resemble newly applied pavement. They can be used for rehabilitation of concrete pavement surfaces by grinding a smoother surface, and also to smooth new asphalt pavements beyond the smoothness afforded by the asphalt laydown machine.

Diamond grinding involves removing a thin layer at the surface of pavement using closely spaced diamond disc saw blades. The blade assembly is run at a predetermined level across the pavement surface, which produces saw cut grooves. The uncut concrete between each saw cut breaks off more or less at a constant level above the saw cut grooves, leaving a ground surface (at a macroscopic level) with longitudinal texture. The diamond disc saw blades are a composite of industrial diamond particles and metallurgical powder matrix. Use of the blade ablates diamond particles from the cutting surface to expose new diamond particles, which changes the height of the grinder, and compromises the precision of the grinding.

Major deficiencies of diamond grinders are slow speeds, and limited grinding depths. The cutting rate for diamond blades is inherently slow and cutting to depths of more than 1/8 inch (3 mm) is difficult without reducing forward speed, which is already slow. As the cutting depth is limited, a diamond ground area can still be too high. Bumps are sometimes ground, but remain a bump due to the limited depth of cut of diamond grinders.

In addition, pavement smoothing or grooving with diamond grinders using diamond saw blades leave vertical edges along the cut path. While vertical edges are a benefit to deep concrete cutting, they create a hazard to the traveling public. The vertical edge, if on the downhill side of the road, may increase standing water time which leads to raveling of the surface, and spalling at cracks and joints. Surface deterioration occurs first in areas of high instability, which are at the vertical edges.

SUMMARY

An aspect is an apparatus for smoothing pavement surfaces comprising a smoothing drum and a precision leveler system. The apparatus can restore rough surfaces, or can be used on new pavements to eliminate roughness, and provide a textured smoothness. The present system is capable of precision smoothing, which is smoothing on a scale unobtainable with rotomills or diamond grinders. The result is a surface that is suitable for high-speed highways or airport runway applications, and can equal or exceed the smoothness of newly installed pavement. This can be accomplished without the deficiencies of rotomills and diamond grinders.

Smoothing Drum

The smoothing drum rotates on a horizontal axis, and has a plurality of cutting teeth. Without a correctly designed smoothing drum, creating a ground smooth pavement surface is difficult or impossible. The smoothing drum has superficial similarities to a rotomill cutting drum, in that it comprises cutting teeth mounted on a rotating drum. However, the smoothing drum of the present system has enhanced properties over conventional rotomill cutting drums.

One enhancement involves the smoothness of the cylindrical cutting surface of the smoothing drum. The smoothing drum has a cylindrical cutting surface defined by tips of several cutting teeth mounted on the drum. Each cutting tooth has a cutting tip of an ultra-hard material. In addition, the cutting teeth are mounted on the drum such that cutting tips together form a circumferential cutting surface around drum where the tolerance of the radius distance of the cutting tips to the drum axis is within a predetermined tolerance. Which can be, for example, within 1/8 inch (3 mm), or as small as 0.04 inches (1 mm).

In contrast, the cutting surface of a rotomill cutting drum presented by the rotomill drum teeth is highly variable over the surface of the cutting surface and this variability worsens significantly over time as the drum is used. As discussed above, one reason for the variability in rotomill cutting drums is due to wear of the cutting teeth tips. During use, the carbide cutting teeth usually used wear significantly, shortening the tooth up to 1 cm, or more, before it is replaced. This reduces the cutting radius for that tooth by a similar extent. The wear is sufficient that the precision of the cutter varies significantly during a single cutting job. In addition, the surface of the cutting tip changes shape, which can change its cutting properties.

In the present smoothing drum the teeth tips are coated with an ultra-hard material, which is either diamond, or boron-nitride. Materials of like hardness are also contemplated. Over use of the drum, the wear is negligible as compared to carbide, and the precision of the cutting surface is maintained during a cutting project. Precision and reproducibility are maintained from project to project.

In the smoothing drum, the teeth are mounted on the drum such that the radius between the tooth tips and the spinning axis of the drum are all within a predetermined tolerance. A tolerance of 0.040 inches (1.0 mm) has been found suitable. This may require finishing or reaming the mounting holes on the drum, as the general manufacturing standards for grinding drums to not meet the required standard.

Another factor required to meet the desired tolerance of the radius is the distance between the teeth. The teeth are spaced on the smoothing drum such that adjacent cuts on the pavement from individual teeth are sufficiently close together to provide a smooth but textured surface. The teeth may be arranged in any suitable arrangement, such as staggered or offset rows, one or more helical paths, and the like.

To achieve optimum tooth spacing and tolerances, non-standard construction and specifications for the smoothing drum, teeth, and teeth mounting blocks may be used. A smaller block and tooth size can be designed to facilitate extremely close tooth spacing. Also, the teeth are machined to provide an accurate radial position when inserted. The radial slope of the PCD coated tooth is reduced and controlled. Furthermore, a smoothing drum of the road smoothing machine is machined to hold the blocks with extreme accuracy.

In summary, a smoothing drum with a high tolerance cutting surface can be provided by;

(1) cutting teeth with an ultrahard diamond or boron-nitride surface, (2) cutting teeth with cutting tips mounted within a predetermined fine tolerance (e.g. 1 mm) of the radial distance from the drum axis, and (3) spacing and mounting pattern of teeth such that adjacent cut paths overlap.

Diamond coated teeth have been used in rotomills previously, but the purpose has been to reduce time between tooth replacement. Without also mounting the teeth in a precision manner, having a smooth cutting surface, and having a close tooth spacing and pattern, diamond coating rotomill teeth will at best only marginally increase the smoothing ability of the drum.

Precision Leveling System

A precision leveling system is required to obtain a smooth surface and is defined by reference to an "ideal" or "standard" averaging arm leveling system.

In its basic configuration, which herein is the "standard" smoothing system, the smoothing system has a leveling system with an averaging arm that is supported by a vehicle or carriage with a wheeled frame (e.g. a trailer or truck frame), by a pivot or fulcrum on the frame. The arm extends forward, in the direction of travel, from the pivot to an averaging wheel that is attached to the arm at an averaging wheel axis, but isn't suspended or fixed to the frame. During operation, as the averaging wheel moves up and down in response to irregularities, the arm pivots up and down around the pivot. The smoothing drum is mounted on the arm between the pivot and the averaging wheel on a spin axis transverse to the direction of travel. The wheeled frame has at least two laterally placed support wheels turning on the same axis to maintain the axis of the smoothing drum general horizontal. As the smoothing system travels over a pavement, the averaging wheel precedes the location where the smoothing drum is cutting or smoothing the surface. When the wheel responds to a large irregularity, the drum moves in a like direction, but because it is closer to the pivot it responds to a smaller extent, and at a location behind the irregularity. When the drum reaches the irregularity, the drum is responding to surface ahead at the averaging wheel. Over distance this generally results in an "averaging" where the drum cuts an average profile that is to smoother and with less vertical variation that the original road profile. This averaging effect is increased as the arm length is increased.

The "standard smoothing system" or a "standard leveling system" is the above having an averaging arm length of at least 15 feet measured between the axis of the averaging wheel and the spin axis of the smoothing drum.

The "precision leveling system", as referred to herein, can be defined by comparison to the above standard. In actual practice, a leveling system may have different dimensions and various compound or secondary leveling arms and structures, and may include other leveling schemes such as automatic leveling systems. However, it is contemplated that such a system is a "precision leveling system" if its averaging produces a profile better or equivalent to the profile averaging of the above-defined ideal averaging arm with the recited length. Whether the profile is better or equivalent can be determined by comparison of the leveled profile results obtained by a candidate leveling system and standard leveling system on pavement surfaces with the same profile, or by comparison of profile results, each obtained over time smoothing several comparative pavement surfaces.

Profile can be defined by reference to the International Roughness Index (IRI) or the Profilograph Index (PrI). The IRI is based on the average rectified slope (ARS), which is a filtered ratio of a standard vehicle's accumulated suspension motion (in mm, inches, etc.) divided by the distance traveled by the vehicle during the measurement (km, mi, etc.). IRI is then equal to ARS multiplied by 1,000. IRI can be determined using measurements from any valid profiler (inertial profiler, inclinometer-based device, rod-and-level, etc.) which generates a profile trace showing the "true" shape of the pavement surface. This pavement profile is fed into an algorithm that determines the IRI value for the pavement. IRI can also be crudely measured by response-type systems using correlation to a reference profiler. PrI is generally measured with a profilograph (California-type or Rainhart), although some software programs can compute PrI from a profile trace produced by an inertial profiler. PrI is determined by counting the number of scallops in the profile trace that fall outside of a specified blanking band. 0.2-inch (5 mm) and 0-inch (0 mm) blanking bands are most commonly used in the U.S., although a few regions use a 0.1-inch (2.5 mm) blanking band as well. PrI is sometimes called Profile Index (PI) but the former is more specific.

The "precision leveling system" is defined as a system achieving a profile that is better than or equivalent to that obtainable from a standard leveling system.

The precision leveling system contrasts with systems typically in use. Leveling systems are often generally crude and only marginally effective. Generally, pivoted arms with depth control wheels are relatively short to reduce length of the equipment. These systems essentially trace the existing profile and provide a constant cutting depth. Leveling of high spots requires, for example, a second pass or manual intervention to adjust cutter height. Often sensors are mounted on a longer averaging arm to improve the averaging effect. The equipment is then adjusted to height according to the sensors and automation. This poses several problems, including raising the entire machine when the sensors pass over and detect a small profile change or small obstructions, which can be, for example, as small as a blade of grass.

DETAILED DESCRIPTION

Figure 1:
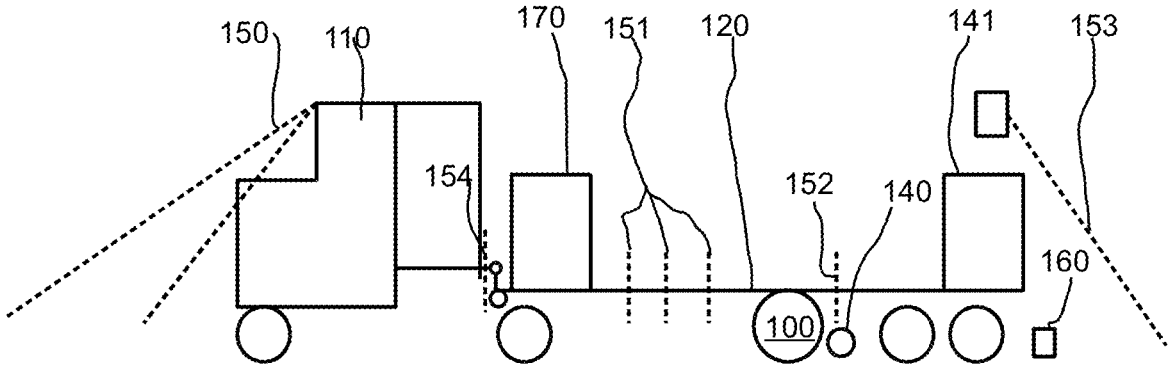
FIG. 1 is a schematic of an exemplary road grinding or smoothing machine.

FIG. 1 depicts an exemplary roadway road smoothing machine.

A smoothing drum 100 may be mounted on a trailer 120. Height sensors 150, 151, 152, and 153 may be mounted on a truck 110 and the trailer 120. A height sensor 154 may sense a position change between the truck 110 and the trailer 120. Combined with a rotational sensor (not shown), the spatial relationship between the truck 110 and trailer 120 may become an additional height input. A water tank 170 may be placed on a front portion of the trailer 120, and a cutting tailings hopper 141 may be disposed proximate to a rear portion of the trailer 120. A broom 140 may sweep directly behind a smoothing drum 100. A paint system 160 may be placed beyond the rear portion of the trailer 120 to mark bumps and dips for later cutting.

Smoothing Drum and Road Texture

Figure 2:
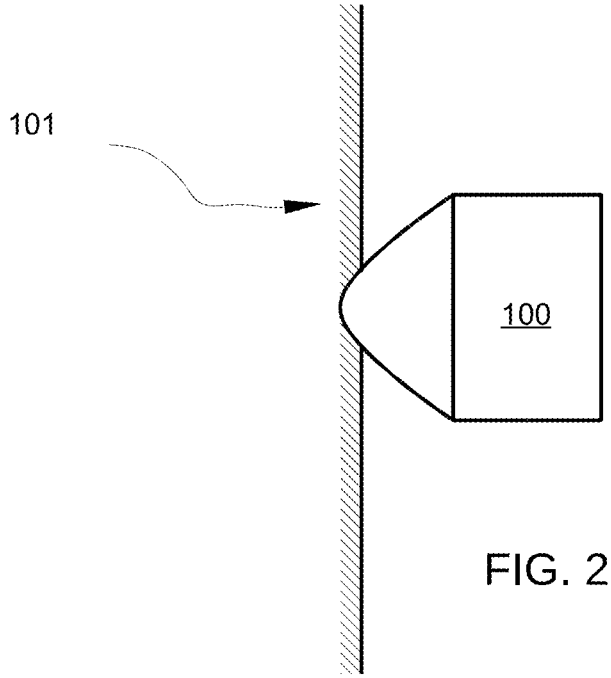
FIG. 2 and FIG. 3 depict an embodiment of a bit 100 grinding a roadway surface 101. The bit may grind to a depth of 0.0625 inches. Such a depth helps create a roadway surface texture that may reduce tire air pumping noise. Such a texture also may provide good skid resistance.

Referring to FIG. 2, an aspect uses teeth tipped with an ultrahard material. Polycrystalline diamond (PCD) tipped teeth have been found suitable accurate road smoothing. A suitable PCD tooth is developed by Novatek, Inc, in Provo, Utah. (See https://www.novatek.com/index.php.) United States Patent Application US20080035386, to Hall, discloses PCD-tipped teeth designed for asphalt rotomilling. These teeth can be adapted to the present road smoothing system.

Other teeth with different construction or with coatings or surfaces of superhard material are suitable. These include, but are not limited to PCD (Poly Crystalline diamond), TSD (Thermally Stable Diamond), CBN (Cubic Boron Nitride), and CVD (Chemical vapor deposition) of diamond or boron nitride. As discussed above, WC (tungsten carbide) wears too quickly and is not hard enough to keep a level cutting surface after extended use.

Figure 3:
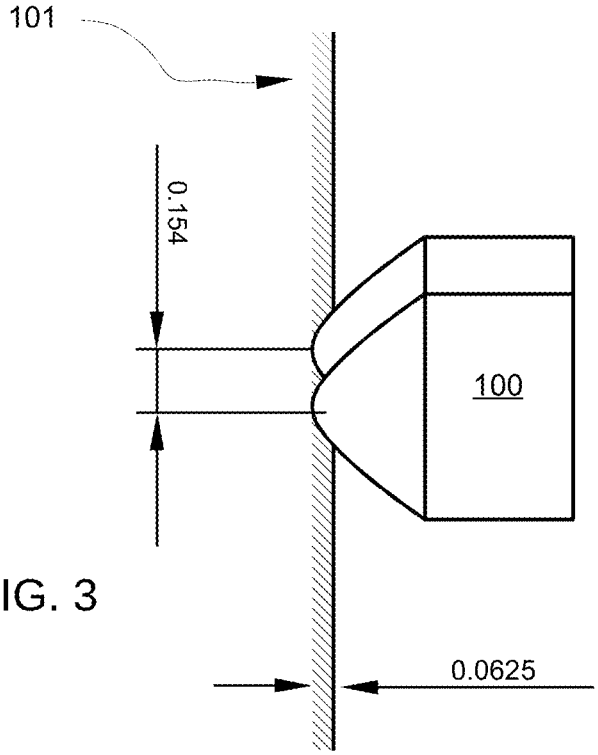

It is known that, square geometries cannot withstand as much stress as triangular geometries. Accordingly, cut channels comprising sharp, square edges in roadway surfaces are more prone to spalling than tapered triangular channels. By employing conically-shaped tips for the cutting teeth, tapered grooves may be cut into the roadway, reducing chances of spalling Reference is also made to FIG. 3. Shown schematically is a tooth tip 100 smoothing a roadway surface 101. The tooth tip may cut to a depth of 0.0625 inches (1.6 mm). The ground paths from the tooth tips may be spaced 0.154 inches (4 mm). Such a depth and spacing helps create a smooth roadway surface texture that may reduce tire air pumping noise. Such a texture also may provide good skid resistance.

Figure 4:
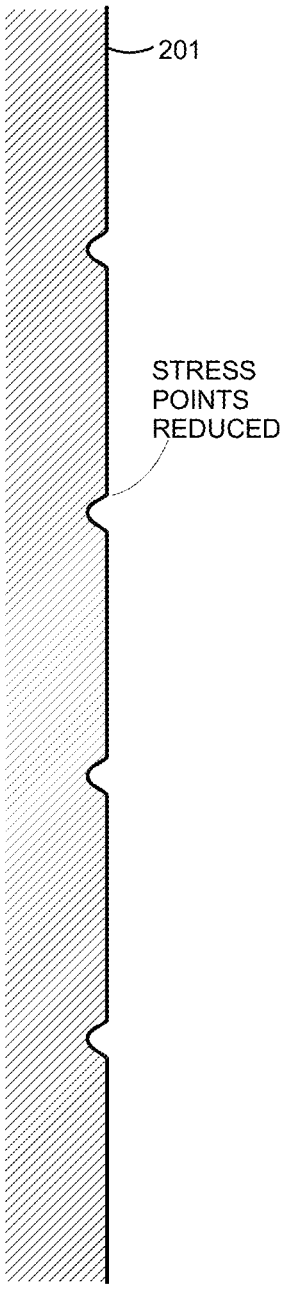
FIG. 4 and FIG. 5 show a roadway surface sharp contour 200 created by conventional road grinding machines. It also shows the roadway surface beveled 201 contour created by an embodiment of the present invention. The embodiment of the present invention may comprise a non-vertical beveled edge, wherein stress points are reduced. The beveled edge may create a durable trough comparatively superior to sharp edged troughs created by the conventional road grinding machines. High stress points created by the vertical saw blades may thus be avoided.
Figure 5:
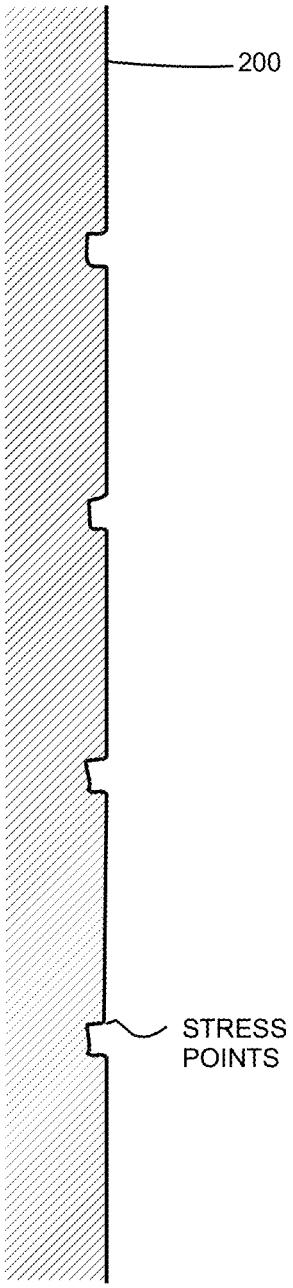

An advantage of the present system is that unlike diamond cutting, the grooves cut into the pavement have beveled edges due to the shape of the cutting teeth tips, and may not have sharp vertical right-angle edges. FIG. 4 is schematic drawing showing a roadway surface sharp contour 200 created by conventional diamond wheel road grinding machines. FIG. 5 shows the roadway surface beveled 201 contour created by an embodiment of the present invention showing a non-vertical beveled edge, wherein stress points are reduced. The beveled edge may create a durable trough comparatively superior to sharp-edged troughs created by the conventional diamond wheel machines. High stress points created by the vertical saw blades may thus be avoided.

The texture of the roadway is important. The present system allows for creating or adjusting the texture of the roadway by adjusting the number of teeth, the angle of skew, and the forward speed. This is not possible by the current method of diamond grinding using saw blades.

In addition, unlike diamond-blade systems, the texture achieved in the present system is durable as the cut groove angles are not parallel to the direction of travel. It may be appreciated that increasing traction on runways and roadways is beneficial. Diverting water to drain from runways and roadways is an essential method for increasing traction. Conventional diamond grooving equipment uses blades rotating on an axis perpendicular to the direction of travel, and accordingly cuts grooves parallel to the roadway. Since the grooves are cut parallel to the roadway, water may become trapped in the grooves and reduce traction or cause other problems. In the present system, grooves can be cut angled to the direction of travel. This may increase traction ratios on grooved, wet roadway surfaces. Cutting angled grooves, i.e., grooves with cut paths that are angled with respect to the direction of travel onto a roadway, may promote water to drain from runways and roadways. In addition, as traffic passes, tires may propel water along through the angled grooves, ridding the surface of free standing water.

Figure 6:
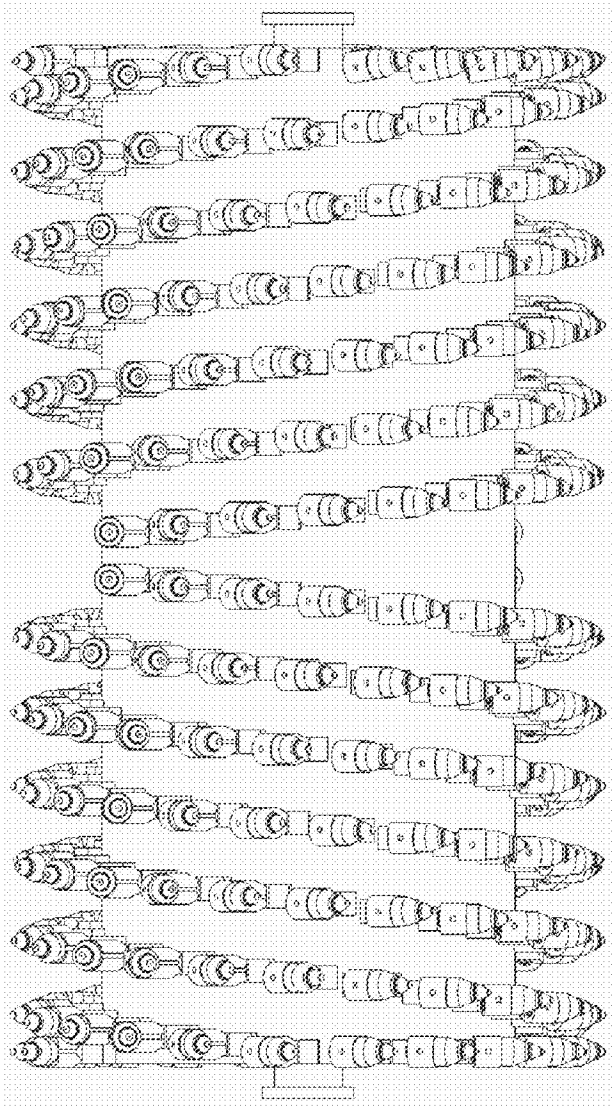
FIG. 6 depicts a smoothing drum with diamonds cutters disposed thereon.

FIG. 6 is a perspective view of an exemplary smoothing drum. The teeth of the smoothing drum do not cut continuous grooves, but cut out scoops or scallops from the pavement surface. The length, orientation and width of the scallops will vary based upon forward speed of the smoothing apparatus, rotational speed and size of the smoothing drum, and the angle or skew of the rotational axis of the drum to the forward travel.

The cutting teeth are placed on the drum such that the cutting paths or cut scallops are adjacent or overlapping, thus presenting an abraded and continuous surface that is smooth at a new level, leaving none of the original surface between scallops.

It may be desirable to ensure that both outermost edges of a cut roadway surface taper to an elevation substantially equal to an existing roadway surface. Since conventional diamond blades cut square channels, they may leave sharp ridges on the outermost edges of the cut roadway surface.

In an embodiment of the present apparatus, a plurality of cutting teeth may be attached to a smoothing drum and may be aligned to produce a desired cut. Cuts in the roadway surface may be appropriately arranged by adjusting a speed of a vehicle and revolution rate of the smoothing drum. In one aspect of the present apparatus, the cutting teeth on the smoothing drum, the speed of the vehicle, and the revolution rate of the drum may produce cuts arranged in such a way to resemble long, continuous channels, but comprising a plurality of cuts.

Skewed/Tapered Smoothing Drum

By rotating the spinning axis of the smoothing drum at an angle nonperpendicular with respect to a direction of traffic on the roadway, the cutting teeth may cut angled scallops in the roadway surface according to the angle of the spinning axis of the cutting drum. In this manner, channels may be created that may be angled in any direction.

An aspect of the present invention comprises the smoothing drum being disposed at a 1 to 45 degree angle from the perpendicular with respect to a direction of traffic on the road, a suitable angle being 5-10 degrees from the perpendicular.

The smoothing drum may also be equipped with conically-shaped diamond cutting teeth tapered at a slightly decreased radius at the outermost edges of the drum in order to leave tapered edges on cut channels to ensure that the edges of the channels are even with existent surrounding roadway surfaces. The smoothing drum then comprises a greater diameter in a middle section than on its edges.

Figure 15:
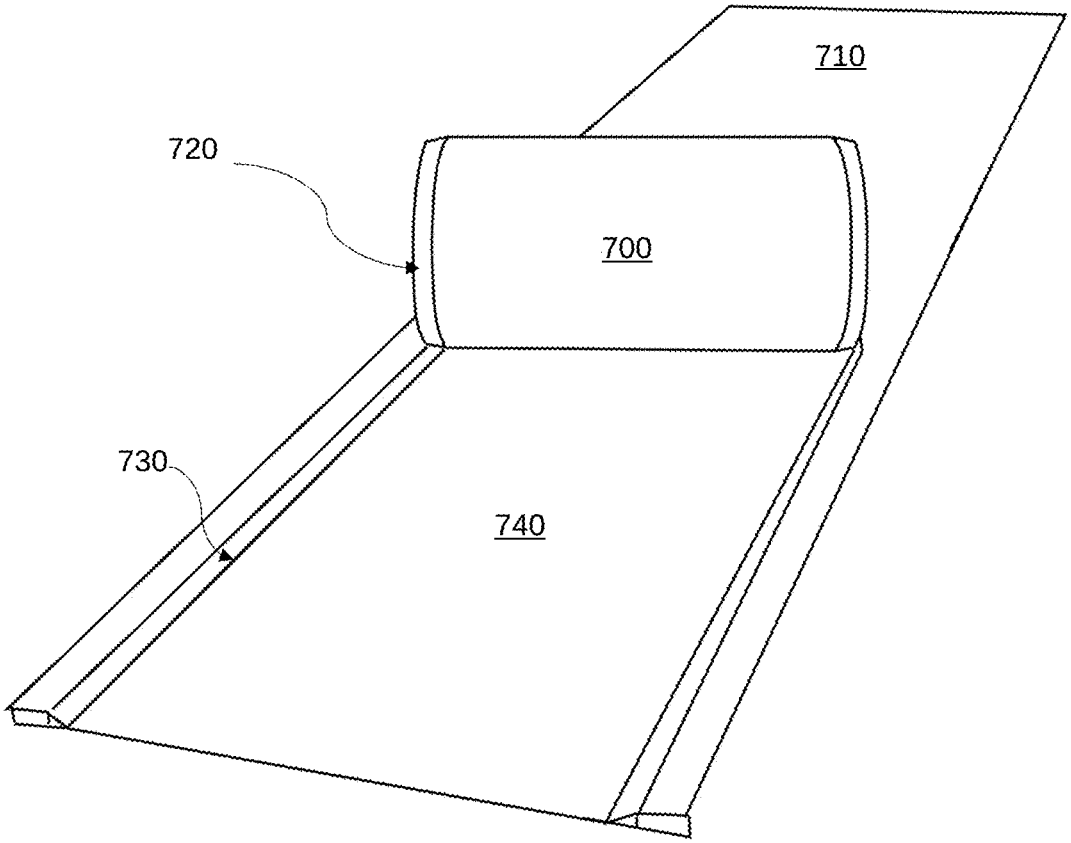
FIG. 15 is a perspective view of a cutting drum.

FIG. 15 is a perspective view of a smoothing drum 700 cutting at a non-perpendicular angle to the direction of travel on a roadway surface 710. The cutting drum 700 may also comprise tapered edges 720. The cutting drum may leave beveled edges 730 on the worked roadway surface 740.

Mounting of Teeth

The conical tipped diamond cutting teeth may be held in place by blocks. An embodiment of the present invention may cut the roadway surface to a sufficient depth while preventing blocks from striking the roadway.

Precision Leveler System

In actual practice a precision leveler system can be constructed as the ideal averaging arm system described above, using one pivoting arm and one leading wheel, and the smoothing drum mount in between, with at least 15 feet (4.6 m). However for practical reasons, the precision leveling system can be constructed to effectively increase the smoothing ability. This can be accomplished, for example, by using compound averaging arms systems, and other constructions designed to improving the profile averaging. These leveling systems are regarded as precision leveling systems as defined here as their averaged profiles are superior to the ideal averaging arm system described above.

One example is embodied is a road smoothing machine and leveling system comprising at least one smoothing drum for taking bumps off of asphalt and concrete pavements as described above. The smoothing drum is mounted on a system of averaging arms, with separate sets of averaging arm or arms disposed on both sides of the apparatus. The back of the averaging arms (the portion disposed behind the smoothing drums) may comprise one wheel. A second wheel, or a 'bogy' configuration, may also be employed. As described below, the configuration with two sets of averaging arms provides a four-point support for the precision leveling system.

The four-point support using two sets of averaging arms is superior over use of only one averaging arm set which usually provides a three-point support (the one leading wheel, and two support wheels on the frame). In the three-part support, differences in elevation from side to side are not detected. With averaging wheel path down the center, the averaging effect is the same over the width of the smoothing drum. In addition, because of the tripod orientation the whole vehicle will rock along axes between the averaging wheel and each of the support wheels. This amplifies movement of the smoothing drum when one support wheel moves relative to the other by rocking the entire system back and forth. By having two independently operating averaging arm systems on both sides of the smoothing drum, the averaging effect is improved, and differences in elevation across the travel path are better accommodated.

Additional or secondary averaging arms may also be employed. A front portion of the one or more averaging arms may comprise at least two wheels in contact with a road surface. For example, two sets of two wheels may be in contact with the road surface. Each set of two wheels may be secured together by a lower averaging arm. Each set of two wheels secured by the lower averaging arm may follow the contours of the pavement. An average arm may be operably connected to and disposed between the two sets of two wheels.

A second or middle averaging arm may connect two lower averaging arms providing additional contour averaging.

An upper main averaging arm then rides upon the middle averaging arms and may average heights of the middle averaging arms, wherein the main averaging arm rides at a height equal to the average of all the wheels and averaging arms below it.

Averaging arms disposed beyond a front portion of the smoothing drum may sense an altitude change due to bumps or dips in the pavement. A smoothing drum may be mounted proximal a rear end of the main averaging arm (near the pivot) and be raised and lowered according to the average taken by the averaging arms.

An exemplary road smoothing machine includes one or more adjustable or selectable leveling arms for detecting road smoothness. The arms may be adjusted in length to obtain a selectable degree of profile averaging for smoothing for a particular roadway surfaces. The arms may be adjusted to a shorter length for smoothing bumpy and uneven roads, or may be adjusted to a longer length for smoothing less bumpy and uneven roads. On city streets, a road smoother comprising a short arm setting may be advantageous while on collector roads and highways, a larger, longer arm may be advantageous.

Three-Point Support Precision Leveling

Figure 7:
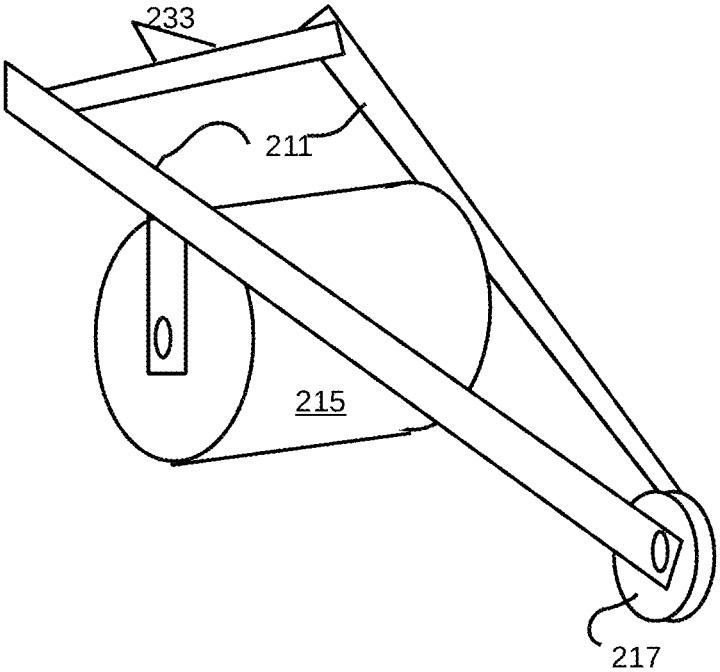
FIG. 7 is a schematic of an exemplary three-point support smoothing system.

Referring to FIG. 7 is a perspective view illustrating an exemplary leveling system. A single averaging arm 211 extends from a supporting pivot 233 to an averaging wheel 217. The pivot 233 is attached to a wheeled conveyance or carriage. Attached to the averaging arm 211 between the pivot and the averaging wheel is a smoothing drum 215. The spinning axis of the smoothing drum is held generally horizontal by side-by-side support wheels on the carriage through the pivot. The length of the averaging arm between the smoothing drum and the averaging wheel is at least 15 feet.

Four-Point Support Precision Leveling

Figure 8:
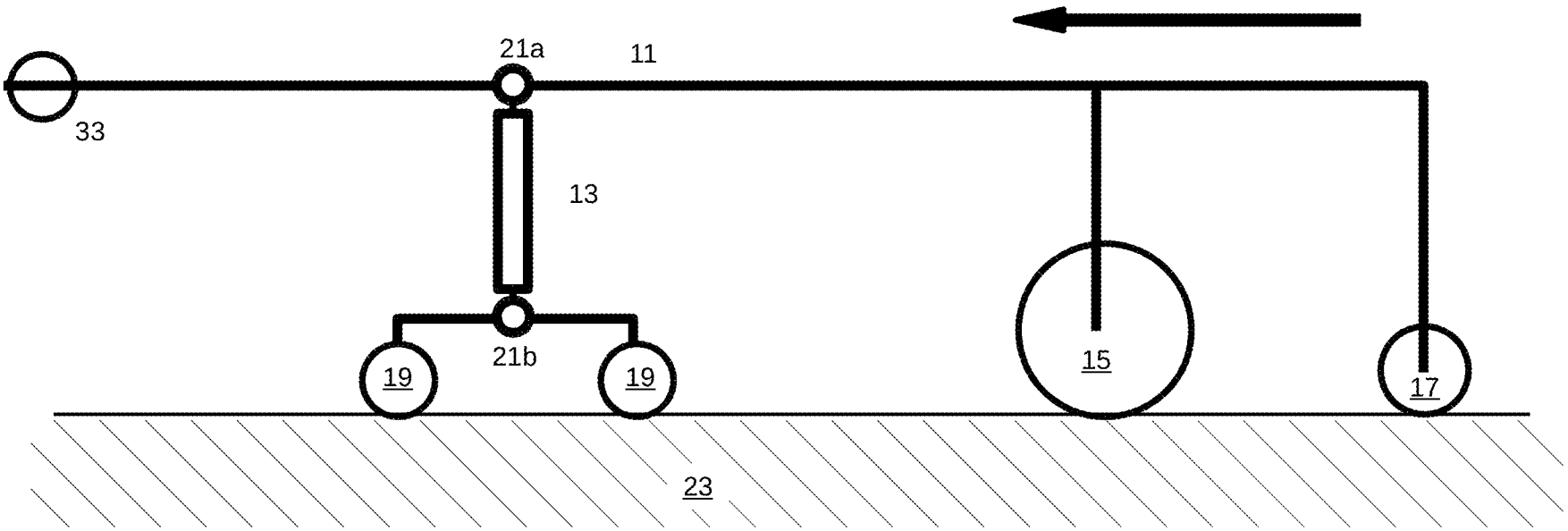
FIG. 8 is a side schematic of an exemplary four-point support smoothing system.

FIG. 8 is a side-view schematic illustrating an exemplary four-point leveling system. A system of averaging arms disposed laterally on each side of smoother apparatus provides two averaging arm systems on either side of a smoothing drum. For each averaging arm system, main or upper averaging arm 11 is supported by a fulcrum or pivot wheel 17. The fulcrum or pivot wheels 17 of the two leveling systems function as a carriage and support the leveling system as it operates along the road, and each also functions as a fulcrum upon which the averaging system operates.

The averaging system is pulled by attachment 33 to a suitable conveyance. Suitably, attachment is from the underside of a truck bed or to the underside of a conventional trailer of a tractor-trailer truck. The smoothing system is towed in this embodiment at attachment 33 along the pavement 23 in the direction of the arrow, and the wheels of the conveying trailer/truck do not function as part of the leveling system. However, it is contemplated to have the system pushed, for example, at or near the fulcrum wheel 17, or the fulcrum wheel can be a drive wheel to convey along the pavement. The attachment 33 is structured to permit up and down movement of the upper averaging arm 11, while the upper arm operates from fulcrum wheel 17 and moves smoothing drum 15 up and down. Any suitable conveyance is contemplated. In addition to attachment 33, lifters 75 (shown in phantom) may be used to raise the entire smoothing assembly from the pavement to a non-operating height for transport between job, storage, and maintenance. These may be of any suitable construction, including one or more of hydraulic, geared, screwed, and levered systems.

On each of the two leveling systems between the attachment 33 and the pivot wheel 17 is attached a smoothing drum 15 that extends across the path of the smoother between the two averaging arm systems. A hydraulic cylinder 13 is attached at an upper attachment 21 to the upper averaging arm 11 and at a lower attachment 21*b* to one or more averaging wheels 19. As shown, averaging wheels 19 are attached to a lower averaging arm 30, which is attached at its middle to the hydraulic cylinder 13 at a lower attachment 21*b*. Any suitable height adjusting structure may be used in place of the hydraulic cylinder.

The hydraulic cylinder can be operated in a locked mode, or a variable level mode. The smoothing wheel height is adjusted in the variable level mode, and locked in the locked mode. During operation, the hydraulic cylinder moves the height of the averaging arm/smoothing drum to a suitable smoothing height and then is locked as the system moves and smooths. In the variable mode, the extent of smoothing can be adjusted during operation to conform to varying surface roughness, for example, as determined by previous profile measurements or profiling equipment mounted on the conveyance.

Figure 13:
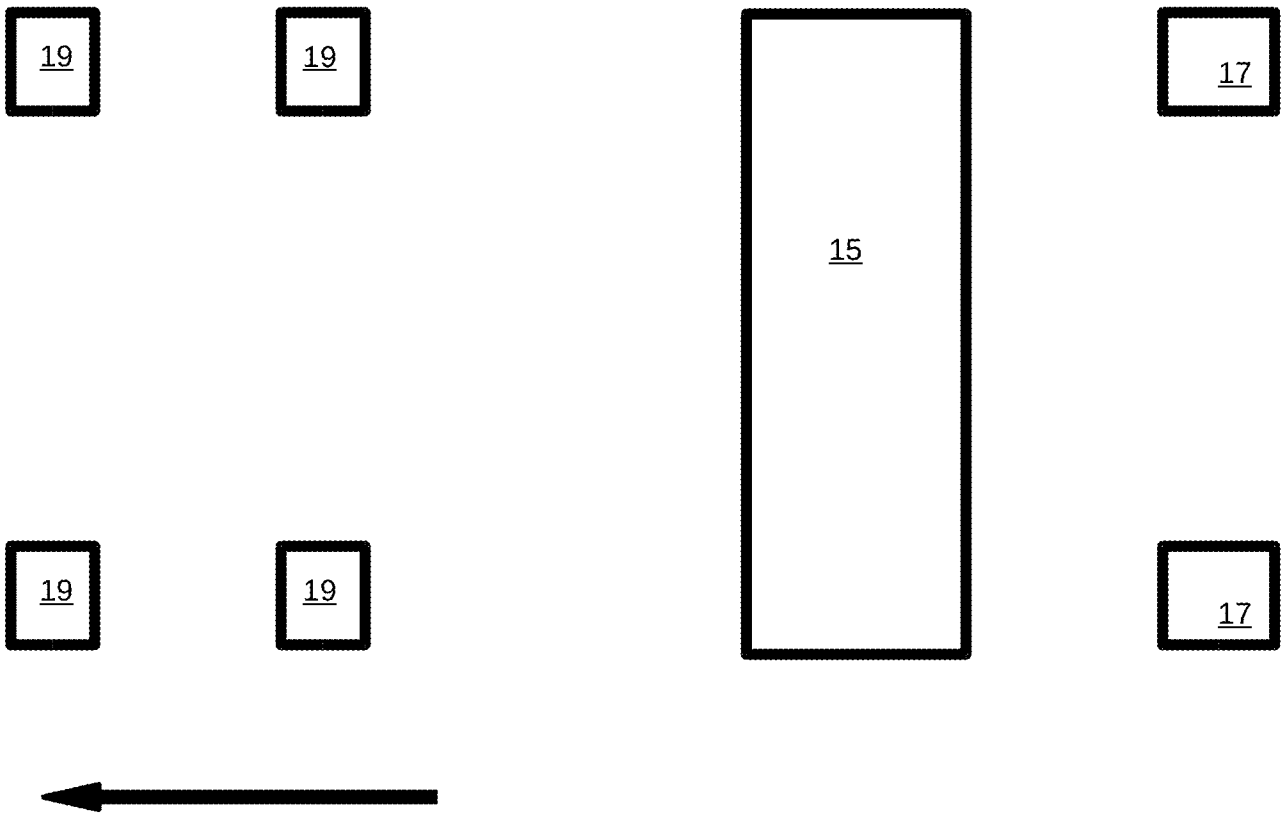
FIG. 13 is a top schematic of a four-point support smoothing system.

Referring also to FIG. 13 a schematic from above of smoothing drum 15, pivot wheels 17 and averaging wheels 19 is shown. The road smoothing apparatus includes two assemblies, each placed on the lateral sides of the apparatus with the smoothing drum 15 in between. Each end of the smoothing drum 15 is supported above the pavement by averaging wheels 19 through the hydraulic cylinders 13 on each side and pivot wheels 17 on each side, resulting in a four-point support of the smoothing drum 15. Two points are provided by left and right pivot wheels 17, and two points are provided by left and right lower averaging arm/averaging wheels assemblies. The two averaging wheels 19 (shown in bogied assemblies that are connected by a lower averaging or bogy arm 20 shown in the FIG. 8) may be replaced with single averaging wheels.

Adjustable Averaging Arms with 4 Point Support

Figure 9:
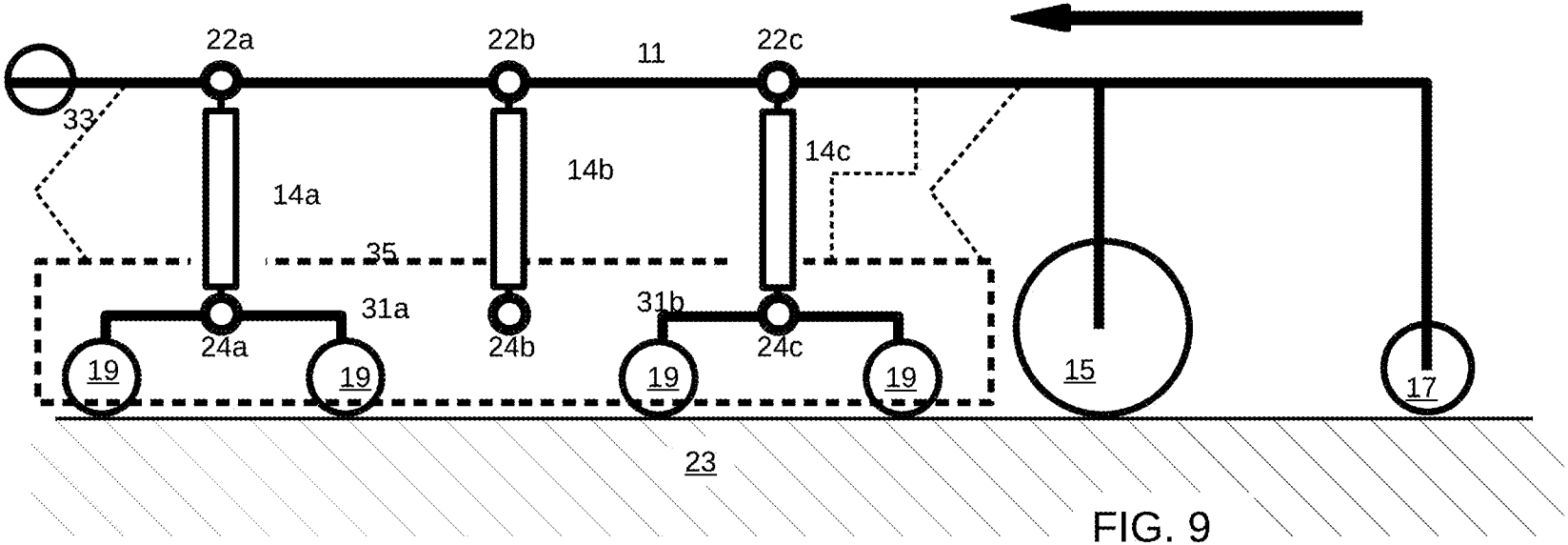
FIG. 9 is a side schematic of a four-point support system with adjustable averaging arms.
Figure 10:
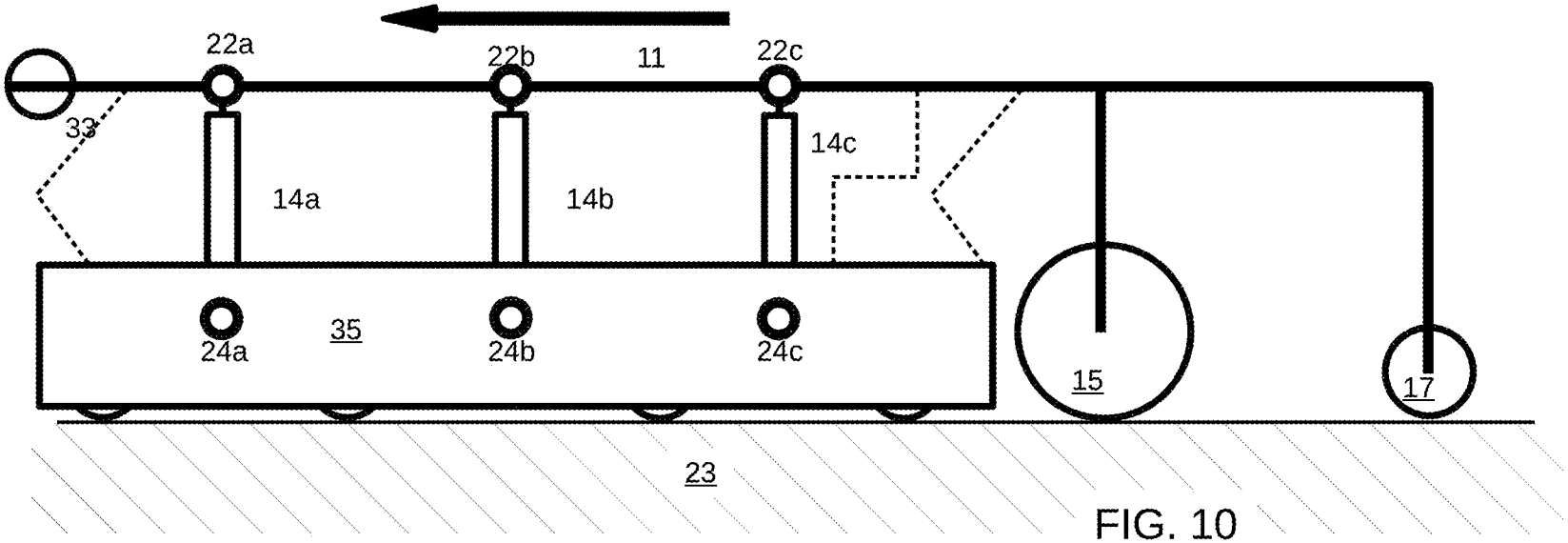
FIG. 10 is another side schematic of a four-point support system with adjustable averaging arms.
Figure 11:
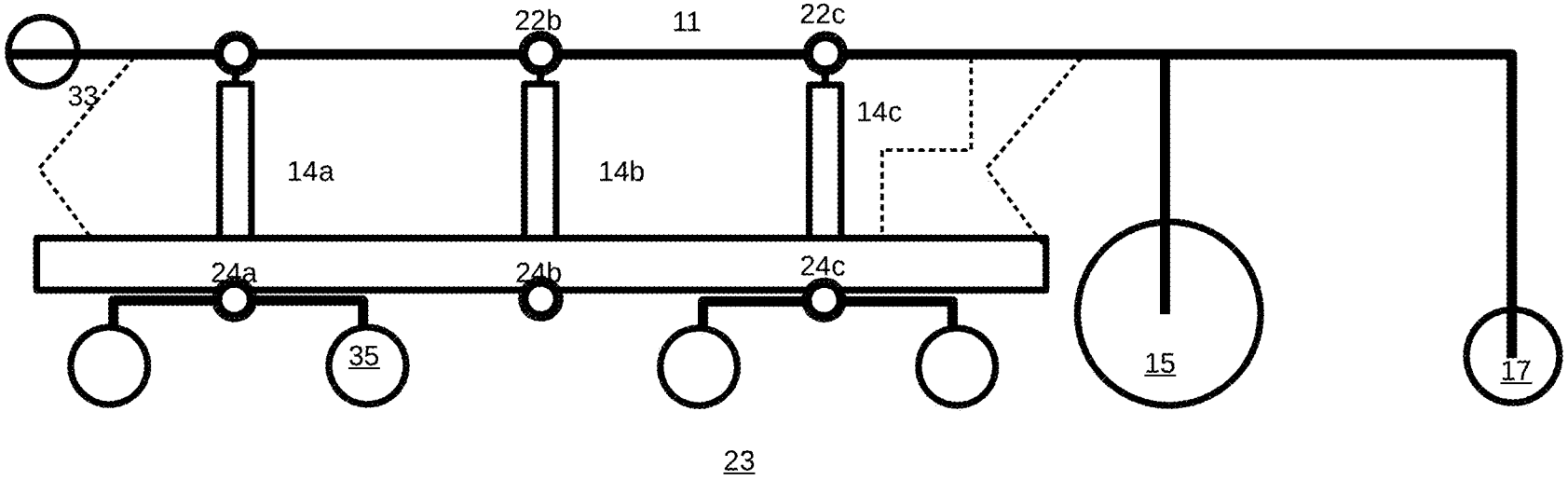
FIG. 11 is aside schematic of an alternate four-point support system with adjustable averaging arms.

Referring to FIG. 9, FIG. 10, and FIG. 11, schematics of a side view of a smoothing system are shown that include two laterally placed leverage arm systems supporting a smoothing drum between them.

The smoothing system comprises upper averaging arm 11, which is supported by fulcrum wheel 17 and any one of three hydraulic cylinders 14*a*, 14*b*, 14*c*, which are in turn supported by averaging wheels 19. The three hydraulic cylinders allow an effective adjustment of the averaging arm length, which makes the smoothing system adaptable to different smoothing requirements.

In a nominal operation, the main averaging arm 11 rides on middle averaging arm 35 through locked hydraulic cylinder 14*b*. The hydraulic cylinder 14*b* is attached to middle averaging arm at mid lower pivot 24*b*. The middle averaging arm 35 may function as a cover of the averaging wheels, as shown in FIG. 9 in phantom to show the averaging wheels, and in FIG. 10 to show it as a cover. The middle averaging arm may also be mounted in a non-covering relationship above the middle averaging arm 35 as in FIG. 11. The middle averaging arm 35 is attached near its ends at lower pivots 24*a* and 24*b* to a fore lower averaging arm 31*a* and aft lower averaging arm 31*b*. Each of the lower averaging arms 31*a*, 31*b*, is supported by two averaging wheels 19.

This nominal operation provides superior smoothing of smaller bumps and dips. This may be the recommended cutting system for most roads. There are instances, however, where more variable averaging is required, such as in urban streets. For example a city street that has intersections commonly involves uneven roadway surfaces. In the intersections, road elevation may change considerably over a small distance. In such close quarter circumstances, conventional road grinding machines with non-adjustable averaging arms cannot adjust to roadway variability, and may produce roads that are uneven. In these circumstances, an averaging arm capable of adjusting to a different length may be desirable.

The present disclosure describes a novel machine capable of adjusting its averaging arms to a plurality of settings, each of which may be ideal for varying roadways. Short averaging arms and long averaging arms may be disposed in the machine. It is possible to quickly change between averaging arm lengths, thus allowing one single road smoothing machine to improve the smoothness of various streets, such as urban streets, highways, and/or freeways.

As illustrated, the smoothing drum 15 may be mounted on a main averaging arm 11. The main averaging arm 11 may be connected to a middle averaging arm 35. The middle averaging arm 35 in turn may be connected to one or more lower averaging arms 31*a*, 31*b*. The lower averaging arms 31*a*, 31*b*, may each ride on wheels 19.

The main averaging arm 11 may be connected to the middle averaging arm 35 and the lower averaging arms 31*a*, 31*b* by one or more hydraulic cylinders 14*a*, 14*b*, 14*c*.

Each of the hydraulic cylinders 14*a*, 14*b*, 14*c* may be configured in a plurality of modes. The first mode, or float mode, comprises a float position where an upper reservoir (not shown) and a lower reservoir of the hydraulic cylinder may be ported together, allowing the cylinder to float or move freely up or down. In this mode, averaging movements are not conveyed to the upper averaging arm from respective averaging wheels.

The second mode comprises a locked mode. A cylinder in the locked mode may be locked in its existing position. If a cylinder operates in the locked mode, all other cylinders will operate in the float mode.

The third mode comprises a variable level mode for changing the height of the smoothing drum by raising or lowering the main averaging arm 11. If any one hydraulic cylinder operates in the variable level mode, the other cylinders will operate in the float mode.

In an extended length or freeway operation, the fore hydraulic cylinder 14*a* is placed in locked mode and the other cylinders 14*b*, 14*c*, are in floating mode. The main averaging arm 11 is then supported through fore hydraulic cylinder 14*a* and upper and lower fore pivots 22*a* and 24*a* to fore lower averaging arm 31*a*, which support two averaging wheels 19. In this configuration, averaging length of the main averaging arm 11 ahead of the cutting wheel 15 is extended.

In a short length or local/city operation, the aft hydraulic cylinder 14*c* is placed in locked mode and the cylinders 14*a*, 14*b*, are in floating mode. The main averaging arm 11 is then supported through aft hydraulic cylinder 14*c* and upper and lower aft pivots 22*c*, and 24*a*, to aft lower averaging arm 31*b*. In this configuration, averaging length of the main averaging arm 11 ahead of the cutting wheel 15 is shortened.

One or more absolute encoders or potentiometers may be paired to any one or more of the hydraulic cylinders 14*a*, 14*b*, 14*c*. The one or more absolute encoders or potentiometers may be set to monitor and relay absolute positional information of the one or more hydraulic cylinders.

One cylinder may continuously operate in either the variable level mode or the locked mode at one time, all other cylinders operating in the float mode. Before operation, one of the cylinders 14*a*, 14*b*, 14*c* may be used to adjust the nominal operating height of the smoothing wheel, with the others in float mode. This can be accomplished during operation while the smoother is in forward motion.

Changing the averaging length of the main averaging arm can be easily and quickly changed to adjust to different pavement conditions, which can be during operation and without stopping the forward motion of the smoothing system.

Adjustment of the forward motion of the smoother, operation and speed of the smoother wheel, and operation of the hydraulic cylinders may be done manually, automatically, or autonomously. Full or partial, automatic or autonomous operation may involve data from one or more of GPS and mapping systems, and internal or external environmental or position sensors, receivers, or transmitters.

In the above illustrated embodiments, hydraulic cylinders were used, but other linear motors or actuators may be used that involve one or more or of electric motors, gear trains, electric linear actuators, and the like.

Figure 12:
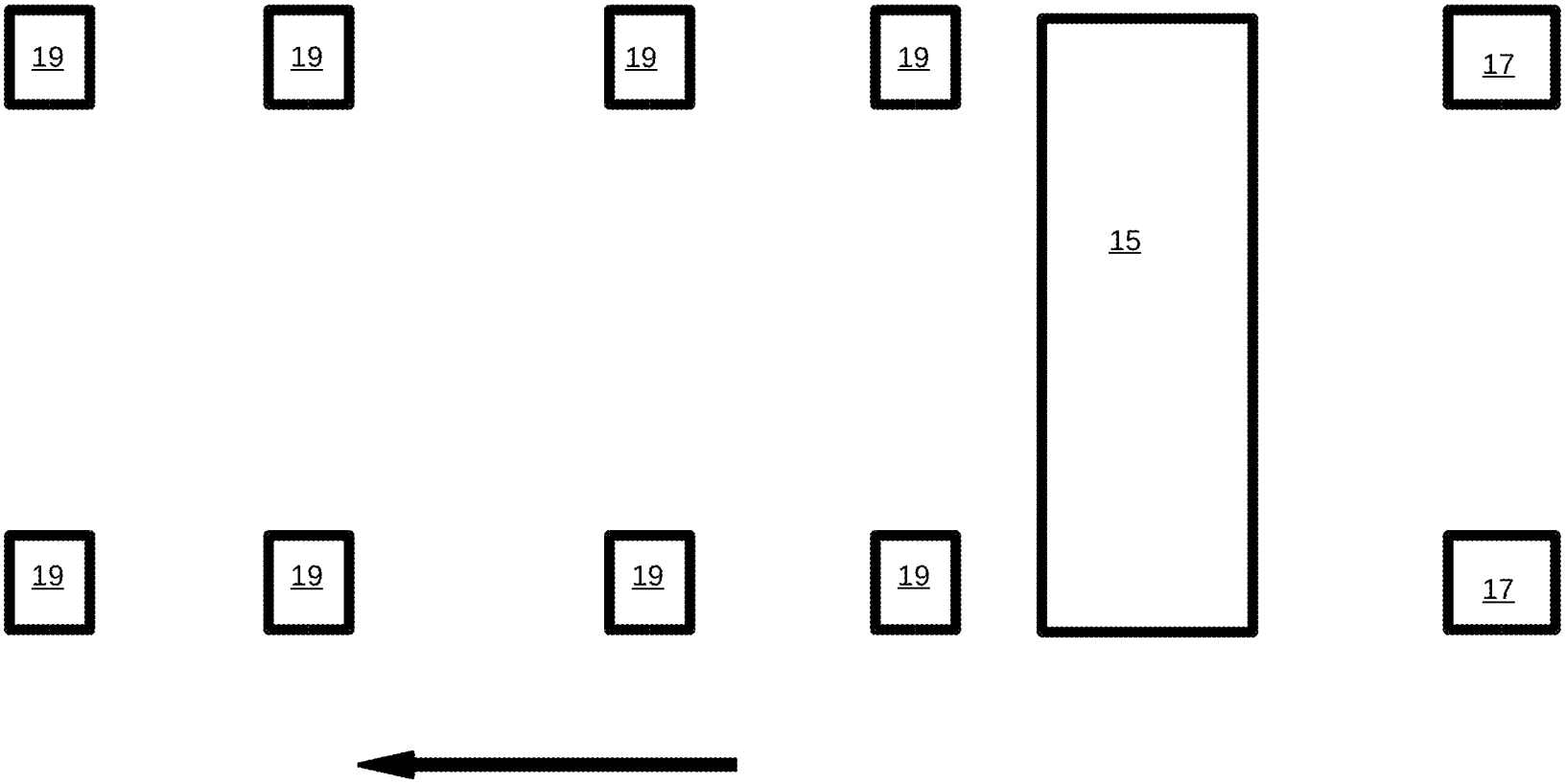
FIG. 12 is a top schematic of a four-point support smoothing system with adjustable averaging arms.

Referring to FIG. 12, a schematic from above showing two of the averaging systems illustrated in FIG. 9, or FIG. 10, or FIG. 11 on each side of a smoothing system vehicle is shown. Note that the ends of the smoothing wheel in this example are on the lateral axes of the pivot wheel 17 and averaging wheels 19. Achieved here is a four-point support of the smoothing wheel.

In a suitable system, the upper averaging arm is around 20 feet (6-7 m) long. The lower averaging arms are greater than 4 feet (1 m), where the averaging wheels with a lower averaging arm form a wheeled bogie construction. While less suitable, the bogie construction can be eliminated and replaced with a single averaging wheel.

A variation of this system is to eliminate the mid hydraulic cylinder 14*b* and associated structure along with the middle averaging arm 35. In addition, either one of the end (for or aft) hydraulic cylinders 14*a*, 14*c* can be eliminated while retaining the middle averaging arm. The adjustability aspect of the system can be expanded by extending the middle averaging arm and adding a fourth assembly that includes hydraulic cylinder, lower averaging arm, and lower averaging wheels.

Integrated Smoother System

Traditional diamond wheel road grinding is a road cutting method used in only a limited variety of applications, such as on new asphalt installations. In conventional embodiments, a roadway surface may require profiling to be done ahead of time, and may also require separate traffic control setups. Furthermore, conventional road grinding techniques require that road grinding equipment be carried to the site, unloaded, and carried away upon completion of grinding bumps.

There is a great need for a road smoothing machine that can accurately and quickly smooth asphalt and concrete pavements. An exemplary embodiment may rapidly cut bumps from all types of roadways while avoiding conventional requirements discussed heretofore.

One use for a road smoother may comprise key cutting low areas of a roadway surface to be patched. Asphalt patches perform optimally if laid ½ inch deep or deeper in the roadway surface. If the area to be patched isn't profiled and marked, a patching crew may experience difficulty when attempting to place the patch at a correct level and in a correct location. Since bumps and dips may be difficult to discern on a roadway surface, patches often produce only marginal smoothing.

An exemplary integrated system includes an apparatus with the smoothing drum and precision leveling system described above. A road smoothing machine, operable by a single operator, may be mounted to a semi-trailer, wherein the semi-trailer may be driven to a cutting site to perform a cutting operation. Accordingly, this exemplary machine allows rapid cutting of bumps from all types of roadways.

A smoothness or roughness of a roadway surface may be gauged by profiling. Profiling of the roadway surface may be accomplished on the truck and trailer ahead of the smoothing drum. The profiling may be accomplished by, for example, sensors or other suitable profilers. This may greatly speed up the road smoothing process, since both the profiling and the cutting is performed by a single machine, avoiding a need for separate traffic control and hand-painting areas to be cut. The machine may be pulled by the tractor at a forward speed of 5-10 mph until the profilers sense an area to be worked, upon which the machine can be slowed during the actual cutting. Profile measurements may also be accomplished in a separate vehicle traveling ahead of the smoothing machine.

Sweeping of a newly cut roadway surface may be accomplished directly after the smoothing drum performs a cut and before an averaging arm touches the newly cut roadway surface. A cuttings hopper may hold as much as 5 tons, allowing a full day's work to be done before dumping, depending on a cutting depth.

In an exemplary system, the machine may cut a wedge cut (key cut) at a beginning and end of a patch with great accuracy both quickly and efficiently. The patch may have a much better chance of holding up on the ends due to the wedge cut. A proper level of the patch may also be easier to estimate as the proper level comprises a level of the roadway surface on either side of the key cut. A straight edge or string line may also be used by matching the roadway surface to either side of the key cuts.

Traffic can be managed in many cases with a simple arrow-board on the back of the trailer.

The machine may include different aspects such as a smoothing drum for smoothing roadway surfaces mounted on a truck or a trailer pulled behind a truck capable of highway speeds. The smoothing drum can be positioned up for highway travel or down on hard (non-pneumatic) wheels for smoothing. A method for cleaning cut material from the roadway in front of the rear wheels is also contemplated.

Another aspect is a machine as above with integral height sensors or inertial sensors to gather road profile data.

Also, the machine may include a computer capable of storing and processing previously determined height and profile information to automatically adjust smoothing drum. This information can be determined by profiling systems traveling before the smoothing system, or independently obtained data.

Another aspect is the pavement smoothing machine comprising two averaging arms positioned at outer extents of a smoothing drum, the averaging arms being substantially parallel to each other.

Another aspect is a pavement smoothing machine wherein the machine is controlled to have a maximum cutting depth of 0 to 0.5 inch (0-13 mm), and suitably controlled to have a maximum cutting depth of 3/16 or 1/4 inch (5 mm or 6.4 mm).

Another aspect is a pavement smoothing machine further comprising an integral means to clean cut or ground off tailings before rear tires pass over a worked area.

Another aspect is a pavement smoothing machine comprising a drum with super hard cutting teeth positioned on a spinning axis on a skew to the direction of travel.

Another aspect is a pavement smoothing machine comprising a drum with tapered ends.

Another aspect is a machine with a smoothing drum for smoothing roadway surfaces mounted on a trailer. A broom or air sweeping system may be mounted behind the smoothing drum and used for cleaning directly after the smoothing drum. A plurality of height sensors may be mounted in front of and behind the smoothing drum for gathering and storing road smoothness or profile data in a processor.

Precise Raising of Smoothing Drum for Obstacles

Many roadways comprise a plurality of manhole covers disposed on or under the pavement surface. Road grinding or smoothing machines comprising diamond or carbide cutting teeth may be damaged if they strike these manhole covers. It may be desirable to cut a roadway surface as close to the manholes as possible while preventing a cutting apparatus to strike the manhole covers and be damaged thereby.

Those familiar with the art may appreciate a difficulty in avoiding manhole covers since it may be difficult to see exactly when a cutting apparatus needs to be raised or lowered. Prior-art cutting apparatuses commonly comprise a cylinder drum (referred to herein for convenience as a cutting drum) comprising a plurality of cutting teeth disposed thereon commonly disposed near the ground. Additionally, cutting drums may comprise covers for holding cuttings. These covers may make it difficult or impossible to see the cutting drum and manhole cover at the time.

It may be desirable to utilize an apparatus for detecting and marking a position of potentially destructive obstacles while the obstacles are clearly visible. A light or metal detector may be fitted onto the road grinding or smoothing machine to detect and provide input to a computer. For example, a distance traveled by the cutting machine may be monitored in order to execute a function to raise a smoothing drum or a cutting drum over the manhole cover when the drum is close to the manhole cover. The computer may also execute a function to lower the drum when the drum has passed over the potentially destructive obstacle in order to continue with normal cutting operations.

An apparatus may be included for marking manholes to determine a proper time to raise a smoothing drum or a cutting drum to avoid striking a potentially destructive obstacle.

An embodiment of the present invention includes a method to mark a position of a potentially destructive obstacle. An obstacle detection device may be attached to a road grinding or smoothing machine. The obstacle detection device may comprise a width of a smoothing drum or a cutting drum of the road grinding or smoothing machine and may be disposed in a location where an operator may easily see both the obstacle detection device and a potentially destructive obstacle. The device may be disposed close to a roadway surface or may comprise a laser light for shining on the roadway surface. The device may also comprise drag chains or other known apparatuses for demarcating an exact position relative to the potentially destructive obstacle. In other embodiments, a plate made from Plexiglas with a marker line down its center may be used.

Using the computer, a road grinding or smoothing machine operator may mark a starting point and an ending point of the potentially destructive obstacle. The computer may store a depth of cut, a distance to the drum, a diameter of the cutting teeth, and a diameter of the drum.

An encoder may continually update the processor with a forward travel of the machine.

When the road grinding or smoothing machine approaches the manhole, the drum may be lifted to avoid striking a potentially destructive obstacle. Said lift may be accomplished by tying directly into hydraulic cylinders capable of controlling a height of the road grinding or smoothing machine. By using a combination of hydraulic control spools it is easily possible to raise, hold, and lower drum into position. The combination of spools may be connected to the L1 and L2 of the hydraulic cylinders.

The drum may be raised on both sides simultaneously. It may also be raised on only one side. Computer input buttons may need to accommodate a single side or both sides.

Instead of raising a drum away from a potentially destructive obstacle immediately, the drum may be raised gradually. For example when cutting 1" deep, a taper may exit the cut 1" per ten feet of forward travel, yielding a relatively smooth transition for vehicles traveling the roadway.

An exemplary system is a set of devices attached to a roadway cutting machine comprising a marking device that has a size greater than or equal to a width of a cutter of the cutting machine. A marking device may comprise a transparent strip positioned 1 to 12 inches above a roadway surface or a laser light shining on the roadway. The set of devices may comprise a set of input buttons, a processor with data storage capabilities, a forward travel sensor, and a hydraulic spool controlled by said processor to raise a smoothing drum or a cutting drum.

Figure 14:
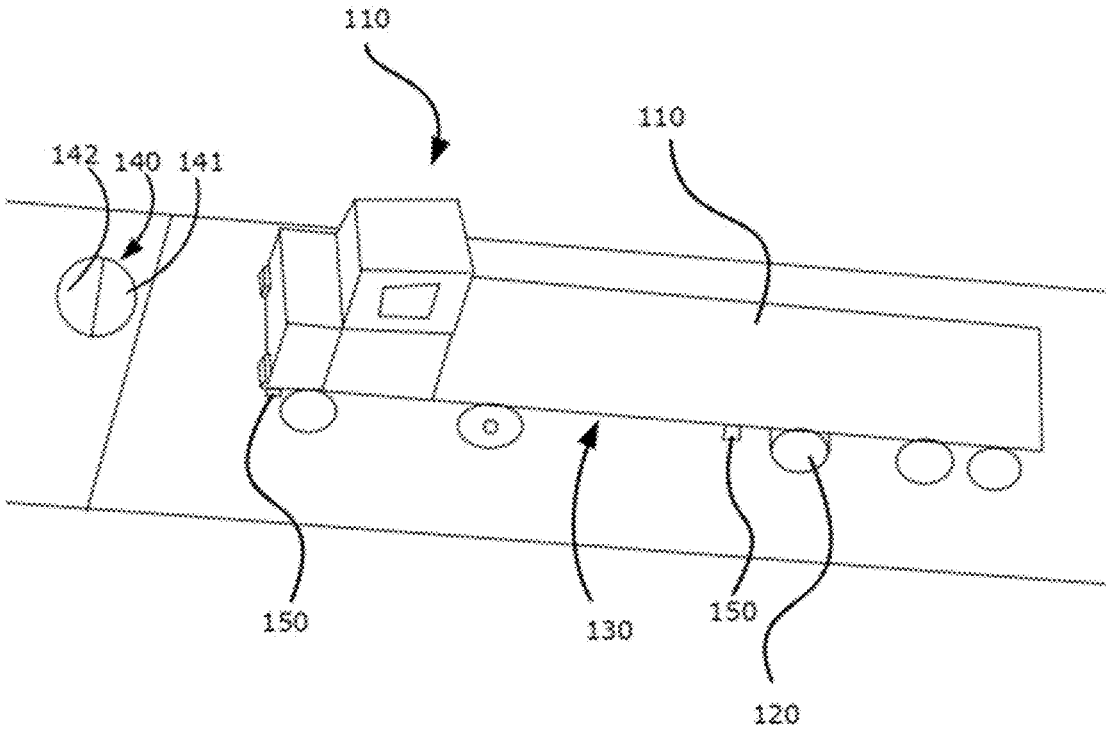
FIG. 14 shows an embodiment of a roadway road smoothing machine for raising a smoothing drum for avoiding a potentially destructive obstacle.

Referring to FIG. 14, a truck 100 is shown with a trailer 110 and a smoothing drum 100 mounted to an underside 130 of the trailer. When an obstacle detection device 180 detects a beginning portion 141 of a potentially destructive obstacle 140, an operator may mark the potentially destructive obstacle 140 by pressing a button (not shown). Likewise, when the obstacle detection device 180 detects an ending portion 142 of the potentially destructive obstacle 140, the operator may again press a button to mark the ending portion 142. Subsequently, when the smoothing drum passes 120 over the potentially destructive obstacle 140, it may be raised by one or more hydraulic cylinders (not shown). Information from a metal detector 150 may match a location of a potentially destructive obstacle 140 marked by the operator. When the metal detector 150 detects a potentially destructive obstacle 140, a computer (not shown) may alarm, stop a forward motion of the truck 100, or raise the smoothing drum 120.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. An apparatus for smoothing pavement surfaces comprising:

a wheeled frame with a precision leveling system for mounting a smoothing drum rotatable on a spinning axis mounted on the wheeled frame generally parallel to a pavement surface to be smoothed, and at a non-perpendicular angle to the direction of travel of the smoothing device.

2. The apparatus as in claim 1 wherein the non-perpendicular angle is between 1 and 45 degrees.

3. The apparatus as in claim 2 wherein the non-perpendicular angle is between 5 and 10 degrees.

4. The apparatus as in claim 1 wherein the cutting drum is tapered at outer ends to decrease radius of the cutting drum at the outer ends.

5. The apparatus of claim 1 wherein the precision leveling system of the wheeled frame comprises a three-point support leveling system with at least one averaging arm.

6. The apparatus of claim 1 wherein the precision leveling system of the wheeled frame comprises a four-point support leveling system with two parallel averaging arm systems disposed laterally on either side of the smoothing drum.

7. The apparatus of claim 6 wherein the each averaging arm-system comprises a single averaging arm or more than one averaging arm.

8. The apparatus of claim 1 wherein the precision leveling system of the wheeled frame comprises two averaging arm systems positioned laterally at outer extents of a cutting drum, the averaging arms being substantially parallel to each other.

9. An apparatus for smoothing pavement surfaces comprising:

a wheeled frame;

a smoothing drum rotatable on a spinning axis mounted on the wheeled frame, the spinning axis being generally parallel to a pavement surface to be smoothed, and at a non-perpendicular angle to the direction of travel of the smoothing device the smoothing drum having a plurality of spaced cutting teeth, each having a cutting tip that is coated with an ultra-hard material; and a precision leveling system for mounting the smoothing drum on the wheeled frame.

* * * * *